US005362336A

United States Patent [19]

Yamaguchi et al.

[11] Patent Number: 5,362,336

[45] Date of Patent: Nov. 8, 1994

[54] PERMANENT MAGNET MATERIAL

[75] Inventors: Tadashi Yamaguchi, Sendai; Naomasa Kimura, Wako; Akihisa Inoue, Sendai, all of Japan

[73] Assignee: Yoshida Kogyo K.K., Tokyo, Japan

[21] Appl. No.: 889,852

[22] Filed: May 28, 1992

[30] Foreign Application Priority Data

May 28, 1991 [JP] Japan ..... 3-124061

[51] Int. Cl.[5] ..... H01F 1/04

[52] U.S. Cl. ..... 148/301; 148/303; 420/83

[58] Field of Search ..... 148/301, 303; 420/83

[56] References Cited

U.S. PATENT DOCUMENTS 5,186,766 2/1993 Iriyama et al. ..... 148/301

FOREIGN PATENT DOCUMENTS 0369097 5/1990 European Pat. Off. .

3-153004 7/1991 Japan ..... 148/301

OTHER PUBLICATIONS

Journal of Applied Physics, vol. 69, No. 9, May 1, 1991, N.Y. U.S. pp. 6735-6737 Y. Otani et al.

Journal of Applied Physics, vol. 70, No. 10, Nov. 15, 1991, N.Y. pp. 6030-6032, M. Endoch et al.

*Primary Examiner*—George Wyszomierski

*Attorney, Agent, or Firm*—Hill, Steadman & Simpson

[57] ABSTRACT

A permanent magnet material having as main components thereof a rare earth element, a transition element (except for rare earth elements and Cu and Ag), and nitrogen and containing as an additive component thereof at least one element selected from the group consisting of Cu, Ag, Al, Ga, Zn, Sn, In, Bi, and Pb. It finds extensive utility in magnetic recording materials such as magnetic tapes, magnetic recording devices, and motors, for example.

22 Claims, 12 Drawing Sheets

PERMANENT MAGNET MATERIAL

BACKGROUND OF THE INVENTION

1. Field of the Invention

This invention relates to a permanent magnet material or a hard magnetic material and more particularly to a rare earth alloy permanent magnet material.

2. Description of the Prior Art

Rare earth alloy permanent magnet materials fit a wide range of applications to magnetic recording materials such as magnetic tapes, magnetic recording devices, and motors and have been finding utility in various technical fields.

There is known that nitrogen is incorporated into rare earth element-transition element type matrix alloys, particularly Sm-Fe matrix alloys, to improve the magnetic properties thereof. These permanent magnet materials are produced by pulverizing a Sm-Fe matrix alloy into minute particles not exceeding several μm in diameter and subjecting the minute particles to a nitriding treatment in an atmosphere of $N_2$ gas at a temperature in the range of from 400° to 650° C.

The conventional rare earth alloy permanent magnetic material, however, undergoes decomposition at temperatures exceeding 650° C. While a compressed piece of pulverized particles obtained by compression molding the particles in a magnetic field is sintered to produce a permanent magnet for practical use, the retention of nitrogen and the magnetic properties of magnet are appreciably degraded. It is, therefore, impossible to form a permanent magnet for practical use by the sintering method without any sacrifice of the outstanding magnetic properties produced by the nitriding treatment.

SUMMARY OF THE INVENTION

An object of this invention, therefore, is to provide a permanent magnet material possessing excellent magnetic properties such that a rare earth element-transition element type matric alloy is enabled to assimilate nitrogen positively during the process of manufacture of a magnet and, at the same time, is allowed to be shaped while the nitride consequently formed is restrained from thermal decomposition.

Another object of this invention is to provide a permanent magnet material which, in the process of manufacture of a permanent magnet for practical use by the sintering method, experiences only a sparing degradation in the retention of nitrogen and the magnetic properties of magnet and permits safe retention of excellent magnetic properties.

To accomplish the objects described above, according to this invention, there is provided a permanent magnet material which has as main components thereof a rare earth element, a transition element (except for rare earth elements, Cu, and Ag), and nitrogen and contains as an additive component thereof at least one element selected from the group consisting of Cu, Ag, Al, Ga, Zn, Sn, In, Bi, and Pb.

Desirably, the content of the rare earth element is set in the range of from 6 to 30 atomic %, the content of the transition element in the range of from 60 to 91 atomic %, and the content of nitrogen in the range of from 3 to 15 atomic %. Meanwhile, the content of the additive component ought to be set in a range in which the magnetic properties of a magnet material formed solely of the main components will not be degraded owing to the use of the additive component therein. Generally in the case of a Sm-Fe-N type alloy, the content of the additive component is desirably set at a level below 4.5 atomic %, though variable with the composition of the matrix alloy and the kind of the additive component.

DETAILED DESCRIPTION OF PREFERRED EMBODIMENTS

The permanent magnet material of this invention is composed of main components and an additive component. The main components include a rare earth element, a transition element (with the exception of rare earth elements and Cu and Ag), and nitrogen and the additive component is at least one element selected from the group consisting of Cu, Ag, Al, Ga, Zn. Sn, In, Bi, and Pb.

In the main components, Sm, for example, is used as a rare earth element. The content of this element is set at a level of not less than 6 atomic % and not more than 30 atomic %. Any deviation of the content of this rare earth element from this range is undesirable because the intrinsic magnetic coercive force is unduly low if the content is less than 6 atomic %, whereas the saturated magnetization is notably low if the content exceeds 30 atomic %.

Fe or Co, for example, is used as a transition element. The content of the transition element is set at a level of not less than 60 atomic % and not more than 91 atomic %. Any deviation of the content of this transition element from the range is undesirable because the saturated magnetization is degraded if the content is less than 60 atomic %, whereas the intrinsic magnetic coercive force is unduly low if the content exceeds 91 atomic %.

The content of N is set at a level of not less than 3 atomic % and not more than 15 atomic %. Any deviation of the content of nitrogen from this range is undesirable because the rare earth element-transition element alloy fails to manifest uniaxial magnetic anisotropy if the N content is less than 3 atomic %, whereas the alloy undergoes phase separation and loses magnetic coercive force if the content exceeds 15 atomic %.

The additive component, in the process of manufacture of a permanent magnet, functions to curb possible thermal decomposition of the nitride of the main components described above. The content of the additive component is set in a range in which the magnetic properties of the nitride are not degraded owing to the use of this additive component.

Among other elements usable for the additive component as mentioned above, Cu, Ag, Al, and Ga are capable of further improving the magnetic properties of the nitride, depending on the content thereof. On the other hand, Zn, Sn, In, and Bi are sparingly effective in enhancing the magnetic properties of the nitride. The content of the additive component will be described more specifically herein below.

Now, this invention will be described more specifically below with reference to working examples. As a matter of course, this invention is not limited to the following examples. It ought to be easily understood by any person of ordinary skill in the art that this invention allows various modifications within the scope of the spirit of this invention.

Figure 1:
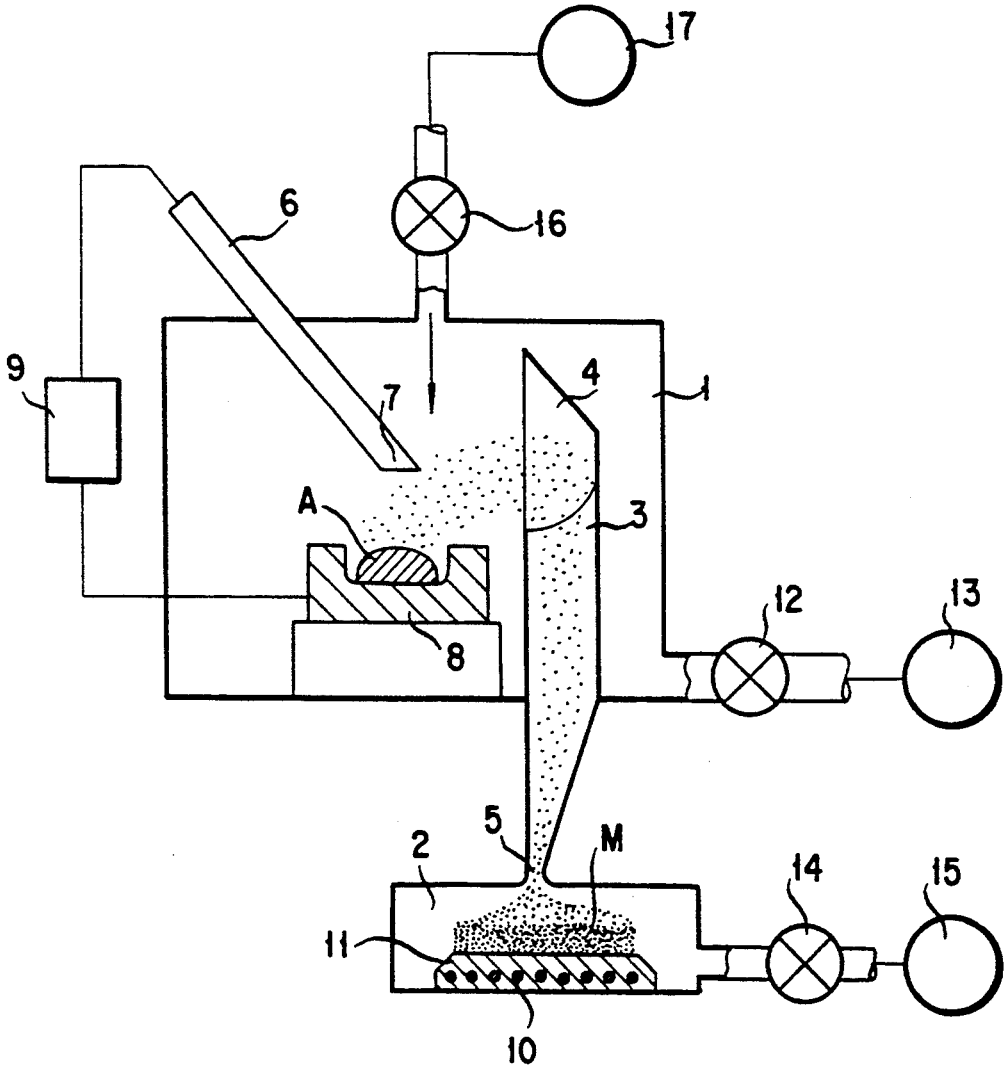
FIG. 1 is a schematic diagram illustrating a first example of the apparatus for the production of a permanent magnet material according to the present invention.

FIG. 1 illustrates an apparatus to be used for the production of a permanent magnet material contemplated by this invention.

This apparatus is provided with a main chamber 1 and a sub-chamber 2 disposed below the main chamber 1. These two chambers 1 and 2 intercommunicate via a duct 3 of which upper opening part 4 is directed toward a hearth 8 made of copper disposed inside the main chamber 1. In the main chamber 1, a W electrode 6 is inserted and set in place so that the leading terminal part 7 thereof is positioned above the hearth 8 of Cu. The W electrode 6 and the Cu hearth 8 are connected to a power source 9. Inside the sub-chamber 2, a substrate 11 provided with a built-in heater 10 is disposed below the lower opening part 5 of the duct 3.

The main chamber 1 is connected via a first valve 12 to a first vacuum pump 13, whereas the sub-chamber 2 is connected via a second valve 14 to a second vacuum pump 15. The main chamber 1 is further connected via a third valve 16 to a processing gas supply source 17 for handling $N_2$ gas, for example.

For the production of the permanent magnet material, the following procedure may be adopted.

(1) A matrix alloy A is placed in the hearth 8 and the substrate 11 is heated to a prescribed temperature.

(2) With the second and third valves 14 and 16 kept closed and the first valve 12 opened, the first vacuum pump 13 is set into operation to evacuate the interior of the main chamber 1 and the interior of the sub-chamber 2 each to the order of about $10^{-5}$ Torr.

(3) With the first and second valves 12 and 14 kept closed and the third valve 16 opened, the processing gas supply source 17 is set into operation to supply such processing gas as $N_2$ gas into the main chamber 1 and the sub-chamber 2. The amounts of the processing gas so supplied are controlled so that the inner pressure of the main chamber 1 falls in the neighborhood of 50 cmHg.

(4) A voltage of 20 V is applied between the W electrode 6 and the hearth 8 to induce arc discharge and vaporize the matrix alloy A.

(5) The inner pressure of the sub-chamber 2 is decreased by opening the second valve 14 and setting the second vacuum pump 15 into operation and, at the same time, the amount of the processing gas being supplied is controlled so that the processing gas flows out of the main chamber 1 into the sub-chamber 2 via the duct The vapor of the matrix alloy reacts with the processing gas. The product of this reaction is carried on the current of the processing gas and then accumulated on the substrate 11 inside the sub-chamber 2, to give rise to a film of permanent magnet M.

Besides the $N_2$ gas, HCN gas, $NH_3$ gas, and $B_3N_3H_6$ gas, etc. are available as the processing gas.

EXAMPLE 1

By using the apparatus described adore and following the procedure described above, a permanent magnet material, $Sm_{11}Fe_{75}N_{12}Ga_2$ (wherein the numerals represent the relevant proportions in atomic %; similarly applicable hereinafter), of this invention about 3 μm in thickness was produced.

The conditions for the production were as follows:
Matrix alloy: $Sm_{17}Fe_{81}Ga_2$, weight 150 g
Substrate: heat resistant glass sheet, temperature 460° C.
Processing gas: $N_2$ gas (purity not lower than 99.99%)
Duration of accumulation: 20 minutes

COMPARATIVE EXAMPLE 1

A permanent magnet material for comparison, $Sm_{11}Fe_{78}N_{11}$, was produced by following the procedure described above, excepting $Sm_{17}Fe_{83}$ was used as a matrix alloy.

Table 1 shows the magnetic properties of the permanent magnet material of this invention and the comparative experiment.

TABLE 1

| No. | Intrinsic magnetic coercive force iHc (KOe) | Saturated magnetization Ms (emu/g) |
|---|---|---|
| Example 1 | 23 | 120 |
| Comparative Experiment 1 | 20 | 123 |

It is clearly noted from Table 1 that the permanent magnet material of this invention, owing to the incorporation of Ga, possesses better intrinsic magnetic coercive force than the permanent magnet material of the comparative experiment.

To study the permanent magnet materials of this invention and the comparative experiment as to susceptibility to thermal decomposition, the two permanent magnet materials were subjected to a heating test performed at 650° C., the temperature at which the materials were shaped during their manufacture, for five hours and then tested for magnetic properties and residual ratio of N. The results are shown in Table 2. The residual ratio of N was calculated by the following formula:

$$\text{Residual ratio of } N\ (\%) = \frac{\text{Amount of } N \text{ after the heating}}{\text{Amount of } N \text{ before the heating}} \times 100$$

TABLE 2

| No. | Intrinsic magnetic coercive force iHc (KOe) | Residual ratio of N (%) |
|---|---|---|
| Example 1 | 21 | 90 |
| Comparative Experiment 1 | 13 | 40 |

It is clearly noted from Table 2 that the permanent magnet material of this invention gave rise to the decomposition product only in a small amount in the heating test and retained its excellent magnetic properties even after the heating test, whereas the permanent magnet material of the comparative experiment succumbed to decomposition in the heating test and consequently suffered from notable degradation of the magnetic properties. Example 2:

Various permanent magnet materials were produced by following the procedure of Example 1, excepting various additive components were used.

Figure 2:
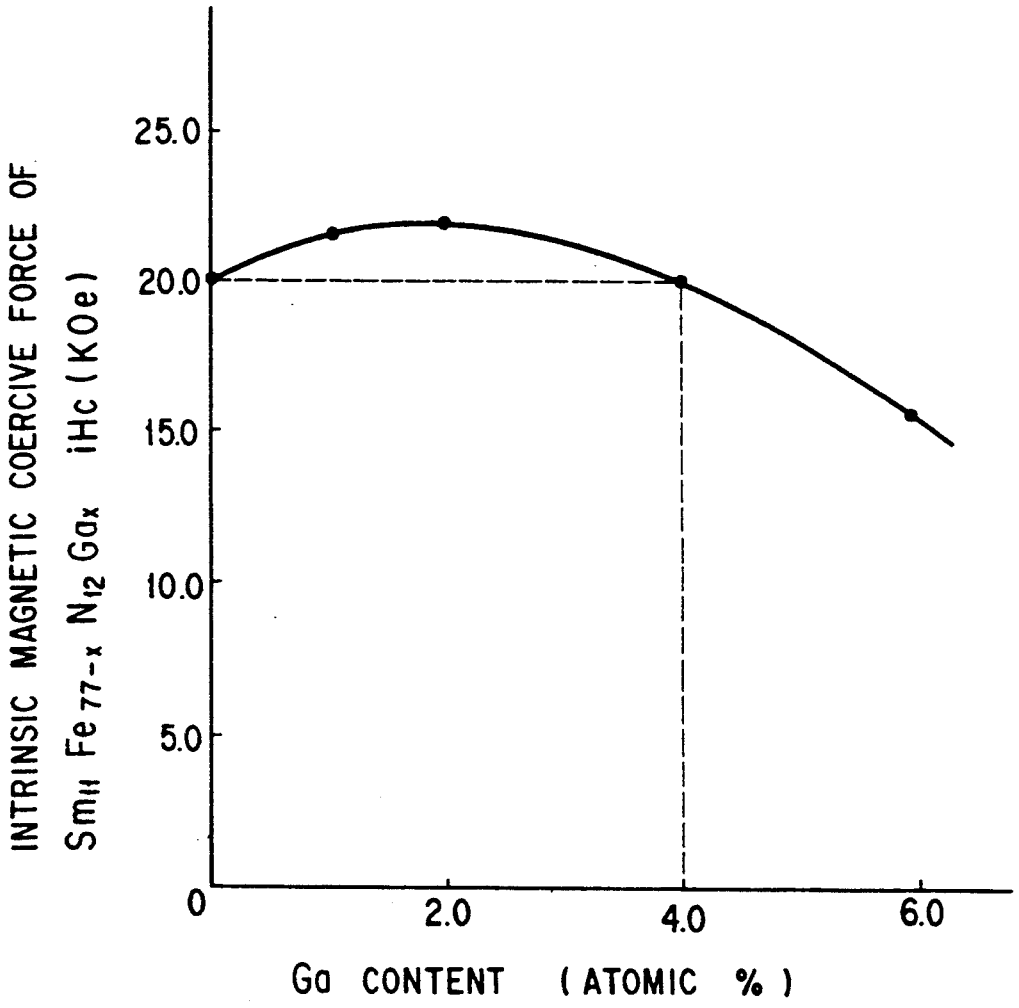
FIG. 2 is a graph showing the relation of the Ga content in an alloy of $Sm_{11}Fe_{77-X}N_{12}Ga_X$ and the intrinsic magnetic coercive force of the alloy.

FIG. 2 shows the relation between the Ga content in the permanent magnet material of this invention, $Sm_{11}Fe_{77-X}N_{12}Ga_X$ (inclusive of the aforementioned $Sm_{11}Fe_{75}N_{12}Ga_2$), and the intrinsic magnetic coercive force thereof. It is noted from FIG. 2 that the content of Ga was set at a level of not more than 4 atomic % under the conditions such that the intrinsic magnetic coercive force of $Sm_{11}Fe_{77-X}N_{12}Ga_X$ would not fall below that of $Sm_{11}Fe_{78}N_{11}$.

Figure 3:
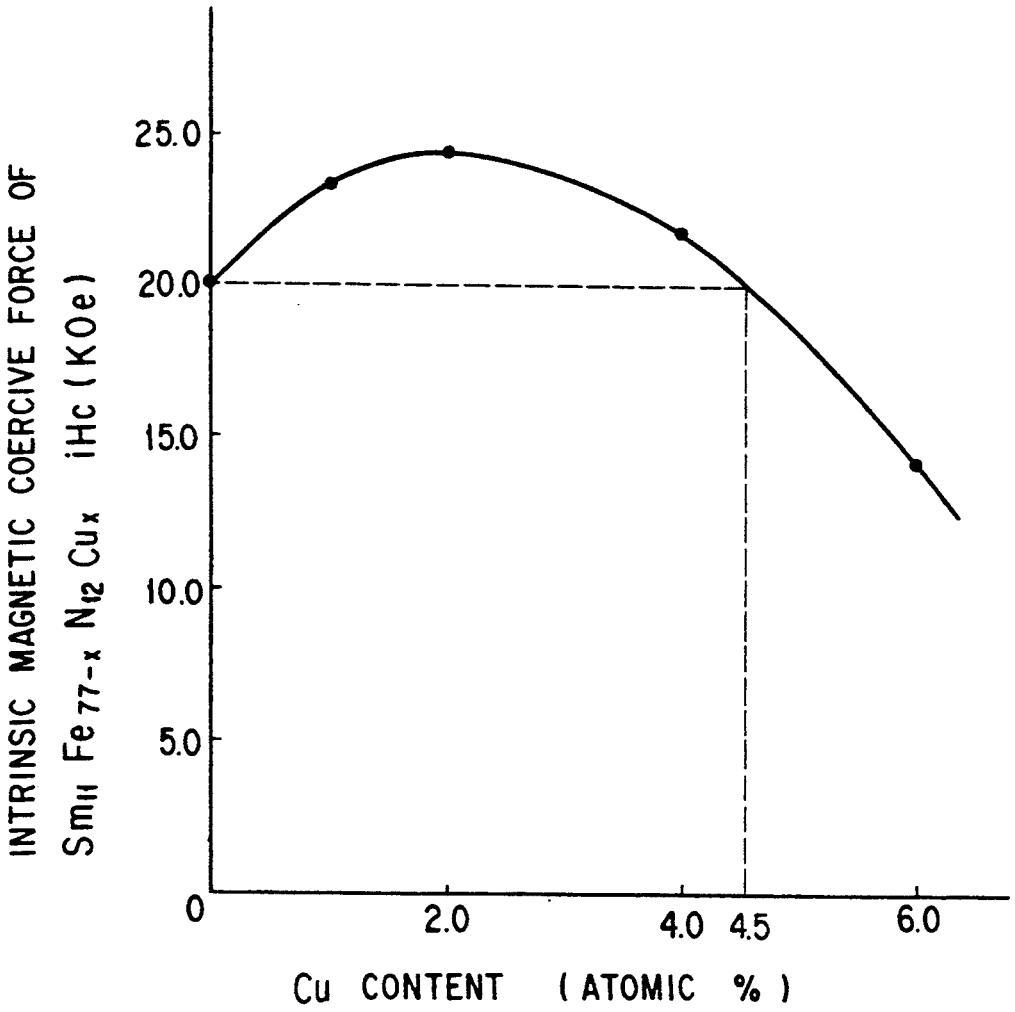
FIG. 3 is a graph showing the relation of the Cu content in an alloy of $Sm_{11}Fe_{77-X}N_{12}Cu_X$ and the intrinsic magnetic coercive force of the alloy.

FIG. 3 shows the relation between the Cu content in the permanent magnet material of this invention, $Sm_{11}Fe_{77-X}N_{12}Cu_X$ and the intrinsic magnetic coercive force thereof. It is noted from FIG. 3 that the content of Cu should be set at a level of not more than 4.5 atomic % under the conditions such that the intrinsic magnetic coercive force of $Sm_{11}Fe_{77-X}N_{12}Cu_X$ would not fall below that of $Sm_{11}Fe_{78}N_{11}$.

Figure 4:
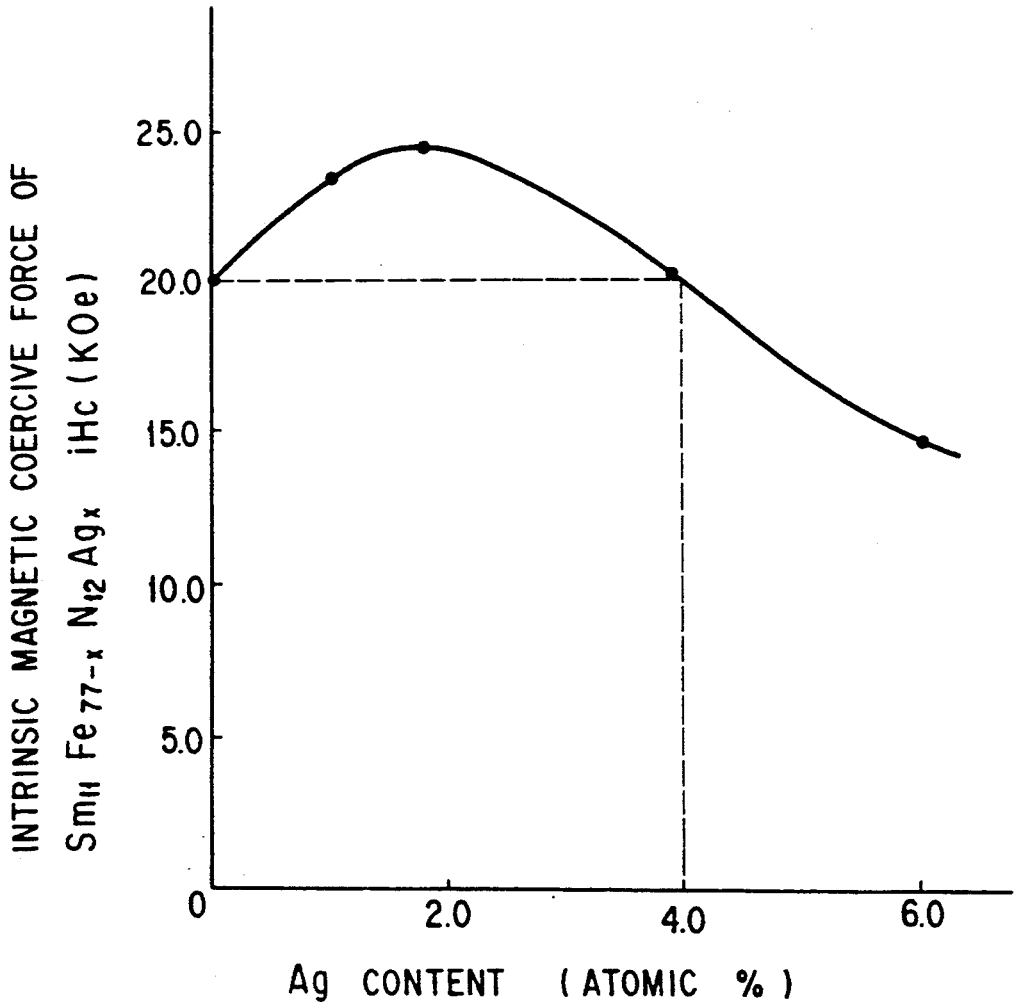
FIG. 4 is a graph showing-the relation of the Ag content in an alloy of $Sm_{11}Fe_{77-X}N_{12}Ag_X$ and the intrinsic magnetic coercive force of the alloy.

FIG. 4 shows the relation between the Ag content in the permanent magnet material of this invention, $Sm_{11}Fe_{77-X}N_{12}Ag_X$ and the intrinsic magnetic coercive force thereof. It is noted from FIG. 4 that the content of Ag should be set at a level of not more than 4 atomic % under the conditions such that the intrinsic magnetic coercive force of $Sm_{11}Fe_{77-X}N_{12}Ag_X$ would not fall below that of $Sm_{11}Fe_{78}N_{11}$.

Figure 5:
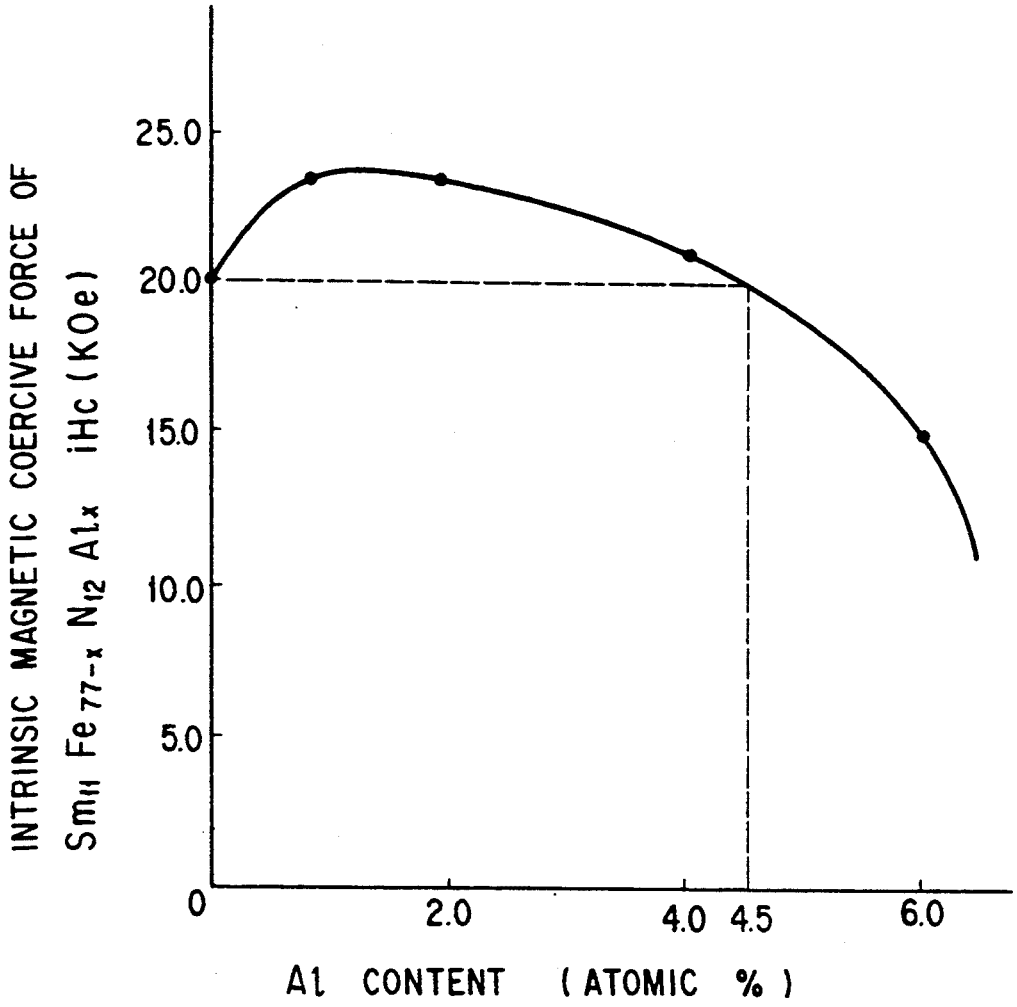
FIG. 5 is a graph showing the relation of the Al content in an alloy of $Sm_{11}Fe_{77-X}N_{12}Al_X$ and the intrinsic magnetic coercive force of the alloy.

FIG. 5 shows the relation between the Al content in the permanent magnet material of this invention, $Sm_{11}Fe_{77-X}N_{12}Al_X$ and the intrinsic magnetic coercive force thereof. It is noted from FIG. 5 that the content of Al should be set at a level of not more than 4.5 atomic % under the conditions such that the intrinsic magnetic coercive force of $Sm_{11}Fe_{77-X}N_{12}Al_X$ would not fall below that of $Sm_{11}Fe_{78}N_{11}$.

Figure 6:
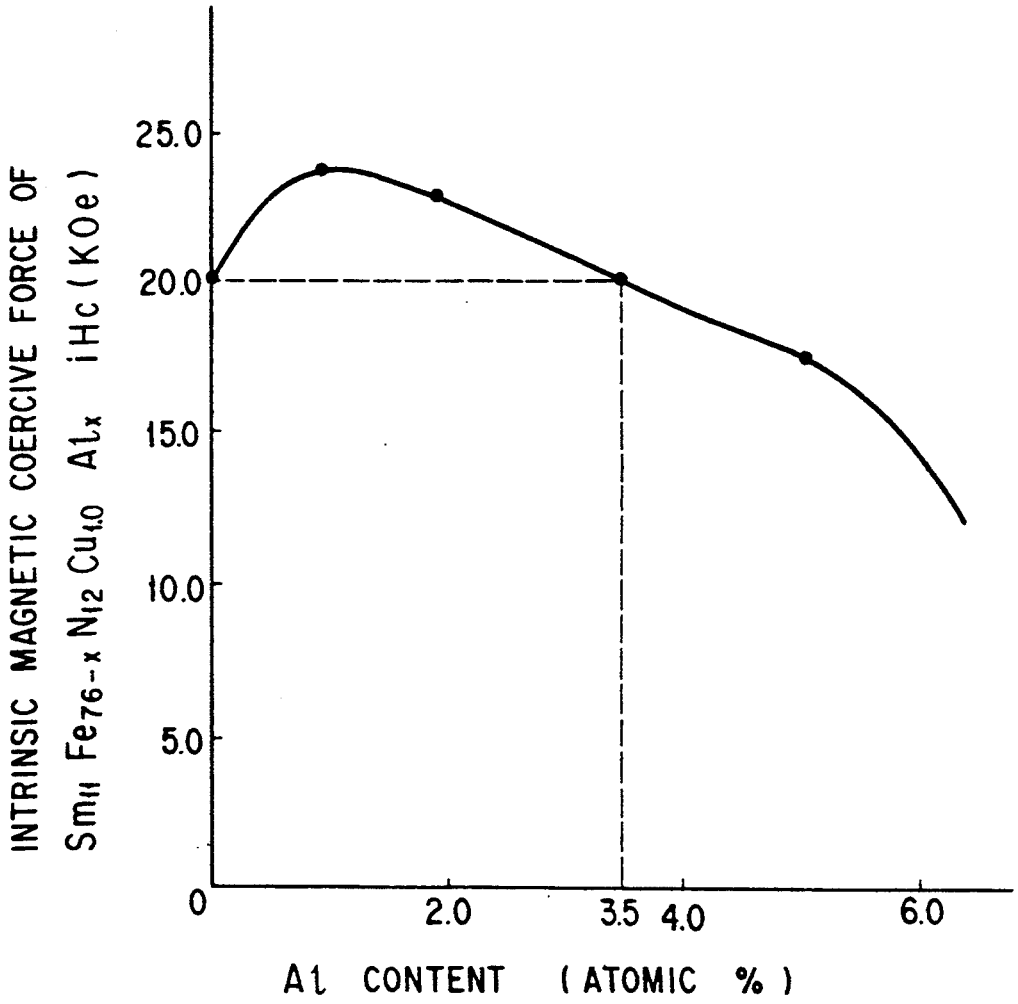
FIG. 6 is a graph showing the relation of the Al content in an alloy of $Sm_{11}Fe_{76-X}N_{12}Cu_{1.0}Al_X$ and the intrinsic magnetic coercive force of the alloy.

FIG. 6 shows the relation between the Al content in the permanent magnet material of this invention, $Sm_{11}Fe_{76-X}N_{12}Cu_{1.0}Al_X$ and the intrinsic magnetic coercive force thereof. It is noted from FIG. 6 that the content of Al should be set at a level of not more than 3.5 atomic % under the conditions such that the intrinsic magnetic coercive force of $Sm_{11}Fe_{76-X}N_{12}Cu_{1.0}Al_X$ would not fall below that of $Sm_{11}Fe_{78}N_{11}$ and the content of Cu is kept at 1 atomic % (constant).

Figure 7:
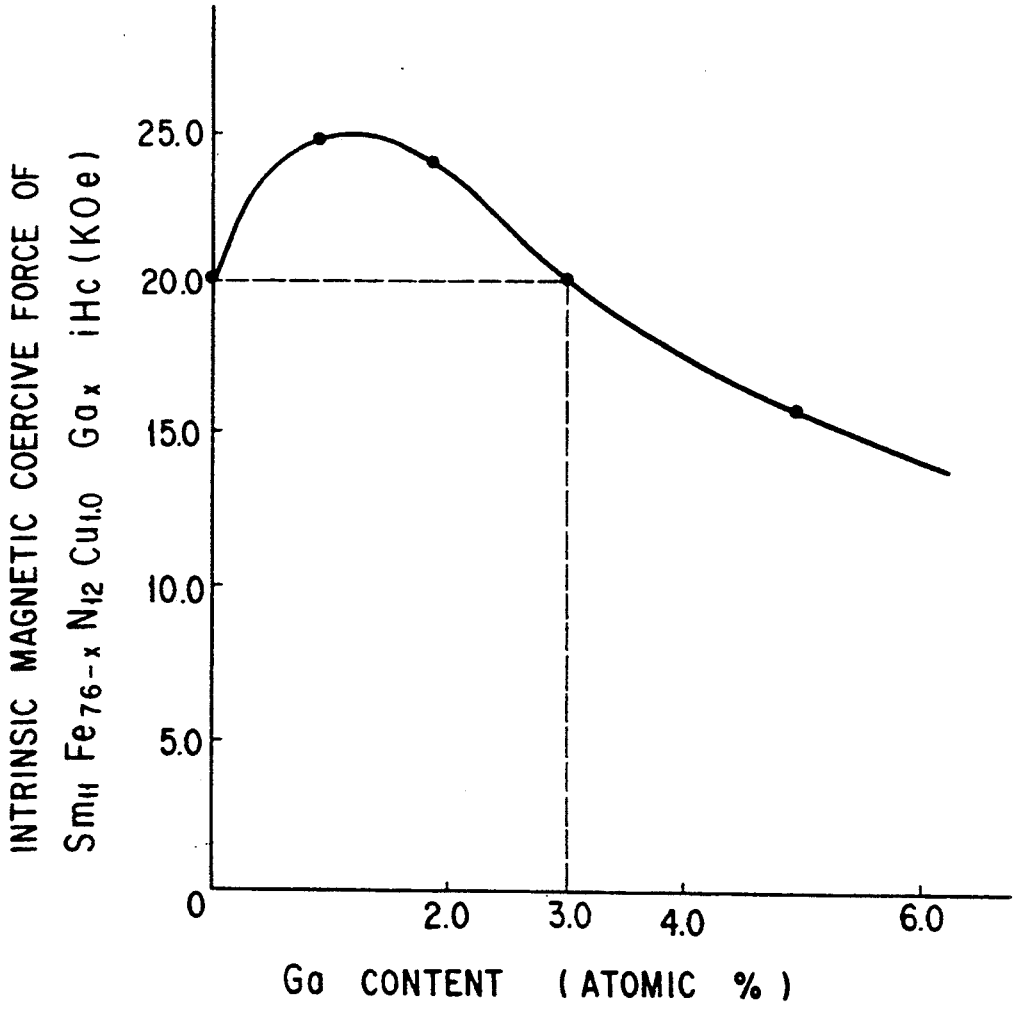
FIG. 7 is a graph showing the relation of the Ga content in an alloy of $Sm_{11}Fe_{76-X}N_{12}Cu_{1.0}Ga_X$ and the intrinsic magnetic coercive force of the alloy.

FIG. 7 shows the relation between the Ga content in the permanent magnet material of this invention, $Sm_{11}Fe_{76-X}N_{12}Cu_{1.0}Ga_X$ and the intrinsic magnetic coercive force thereof. It is noted from FIG. 7 that the content of Ga should be set at a level of not more than 3 atomic % under the conditions such that the intrinsic magnetic coercive force of $Sm_{11}Fe_{76-X}N_{12}Cu_{1.0}Ga_X$ would not fall below that of $Sm_{11}Fe_{78}N_{11}$ and the content of Cu is kept at 1 atomic % (constant).

Figure 8:
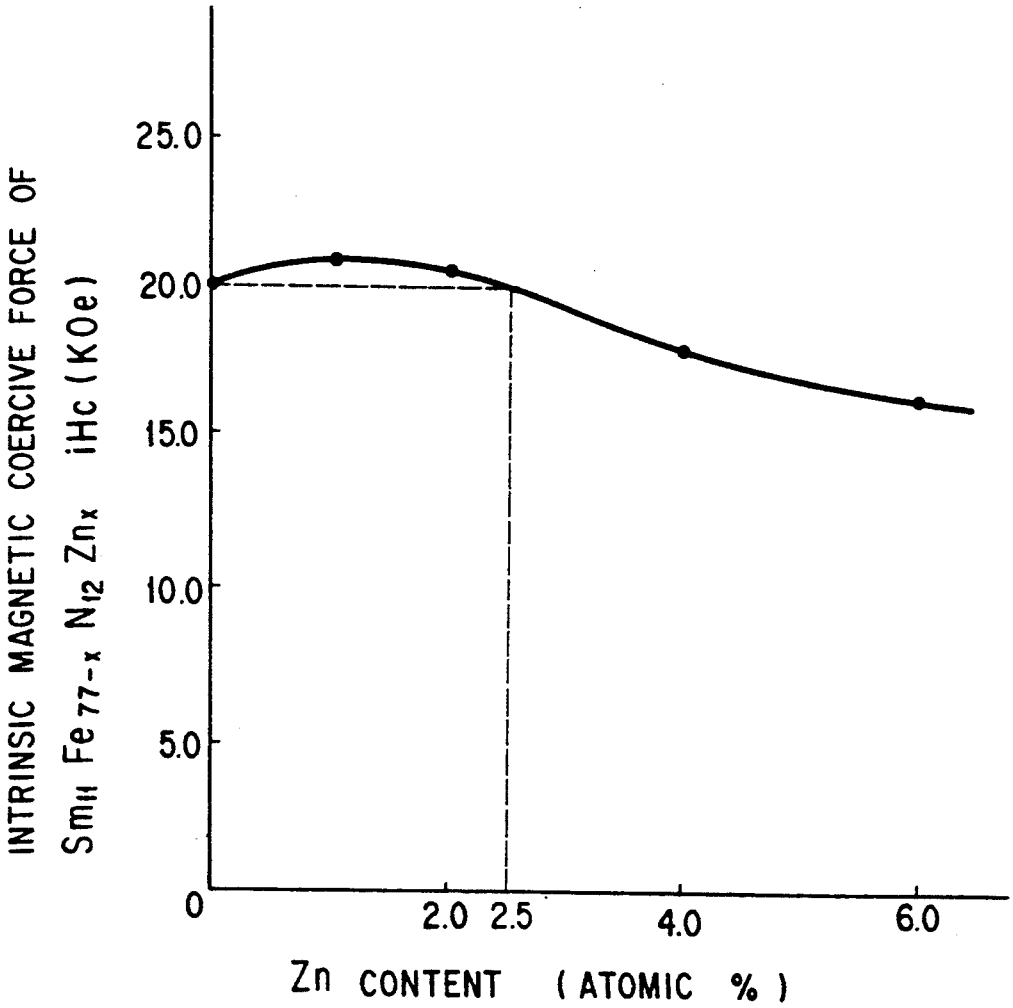
FIG. 8 is a graph showing the relation of the Zn content in an alloy of $Sm_{11}Fe_{77-X}N_{12}Zn_X$ and the intrinsic magnetic coercive force of the alloy.

FIG. 8 shows the relation between the Zn content in the permanent magnet material of this invention, $Sm_{11}Fe_{77-X}N_{12}Zn_X$ and the intrinsic magnetic coercive force thereof. It is noted from FIG. 8 that the content of Zn should be set at a level of not more than 2.5 atomic % under the conditions such that the intrinsic magnetic coercive force of $Sm_{11}Fe_{77-X}N_{12}Zn_X$ would not fall below that of $Sm_{11}Fe_{78}N_{11}$.

Figure 9:
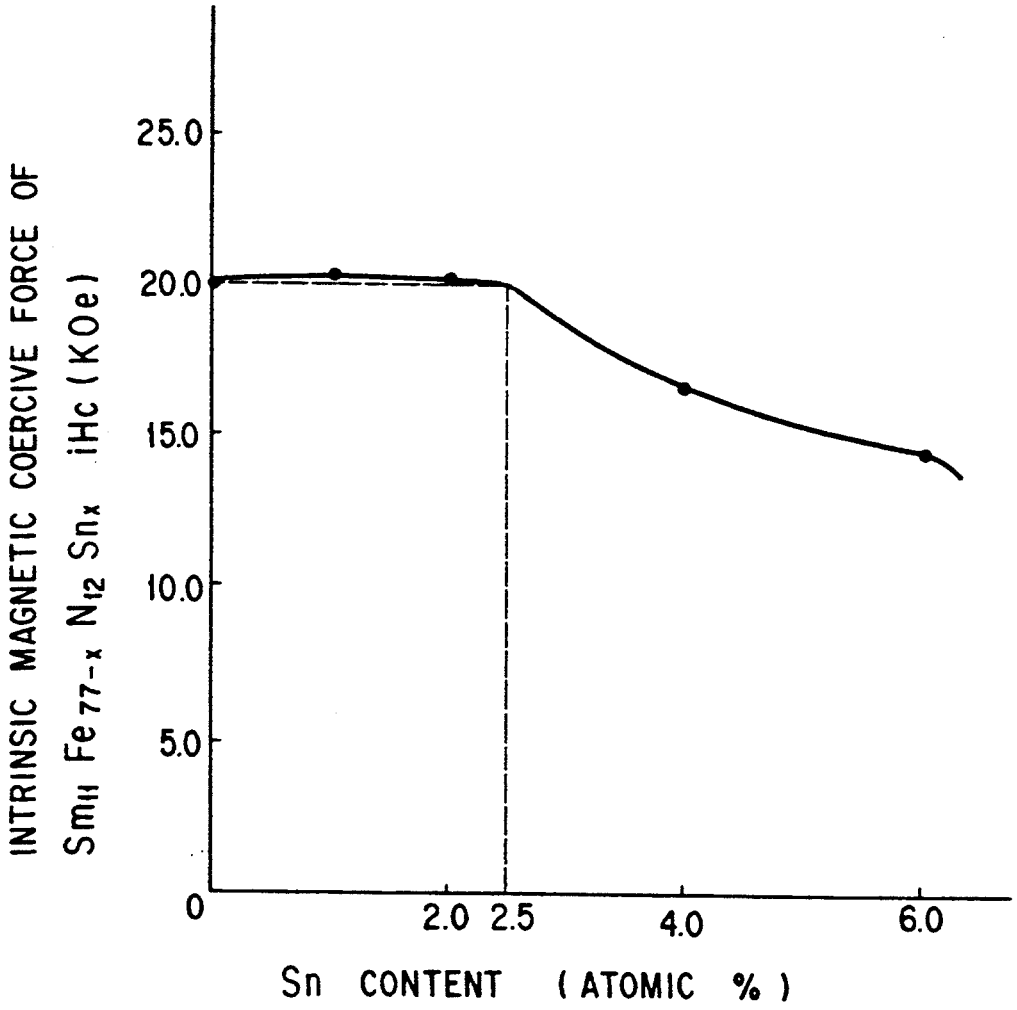
FIG. 9 is a graph showing the relation of the Sn content in an alloy of $Sm_{11}Fe_{77-X}N_{12}Sn_X$ and the intrinsic magnetic coercive force of the alloy.

FIG. 9 shows the relation between the Sn content in the permanent magnet material of this invention, $Sm_{11}Fe_{77-X}N_{12}Sn_X$ and the intrinsic magnetic coercive force thereof. It is noted from FIG. 9 that the content of Sn should be set at a level of not more than 2.5 atomic % under the conditions such that the intrinsic magnetic coercive force of $Sm_{11}Fe_{77-X}N_{12}Sn_X$ would not fall below that of $Sm_{11}Fe_{78}N_{11}$.

Figure 10:
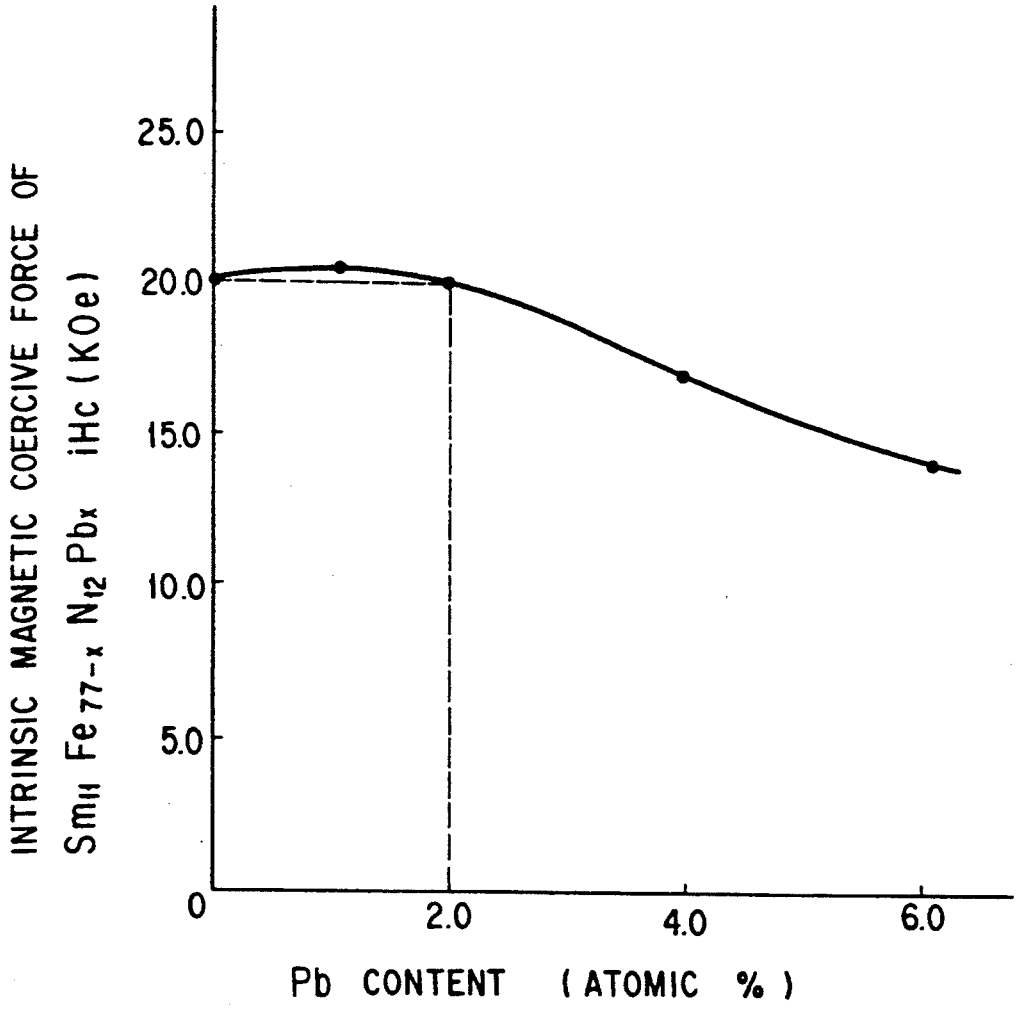
FIG. 10 is a graph showing the relation of the Pb content in an alloy of $Sm_{11}Fe_{77-X}N_{12}Pb_X$ and the intrinsic magnetic coercive force of the alloy.

FIG. 10 shows the relation between the Pb content in the permanent magnet material of this invention, $Sm_{11}Fe_{77-X}N_{12}Pb_X$ and the intrinsic magnetic coercive force thereof. It is noted from FIG. 10 that the content of Pb should be set at a level of not more than 2 atomic % under the conditions such that the intrinsic magnetic coercive force of $Sm_{11}Fe_{77-X}N_{12}Pb_X$ would not fall below that of $Sm_{11}Fe_{78}N_{11}$.

Figure 11:
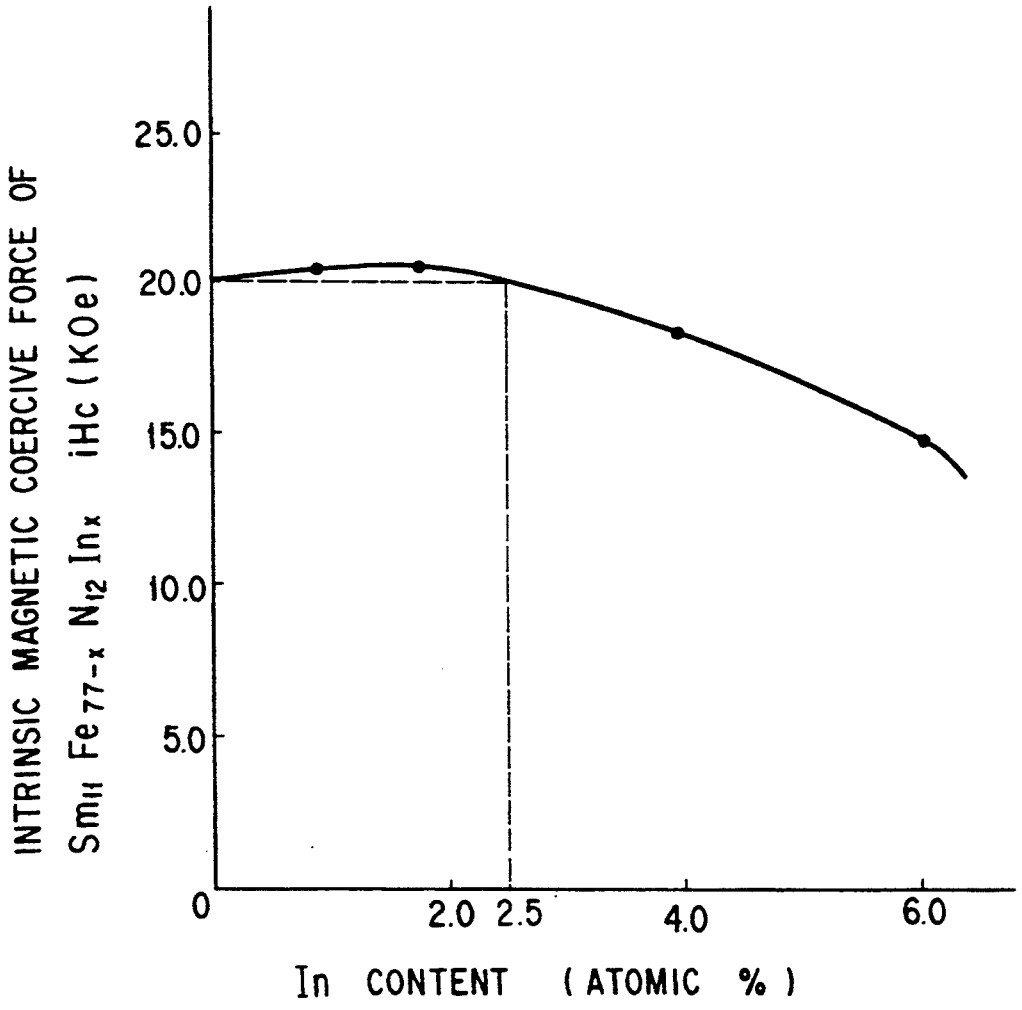
FIG. 11 is a graph showing the relation of the In content in an alloy of $Sm_{11}Fe_{77-X}N_{12}In_X$ and the intrinsic magnetic coercive force of the alloy.

FIG. 11 shows the relation between the In content in the permanent magnet material of this invention, $Sm_{11}Fe_{77-X}N_{12}In_X$ and the intrinsic magnetic coercive force thereof. It is noted from FIG. 11 that the content of In should be set at a level of not more than 2.5 atomic % under the conditions such that the intrinsic magnetic coercive force of $Sm_{11}Fe_{77-X}N_{12}In_X$ would not fall below that of $Sm_{11}Fe_{78}N_{11}$.

Various permanent magnet materials shown in FIG. 3 to FIG. 11 were severally subjected to the same heating test at 650° C. for five hours as described above. The results were as shown in Table 3. The chemical formulas in the table represent the compositions of the permanent magnets of this invention prior to the heating test.

TABLE 3

| Permanent magnet | Intrinsic magnetic coercive force iHc (KOe) Before heating | After heating | Residual ratio of N (%) |
|---|---|---|---|
| $Sm_{11}Fe_{75}N_{12}Cu_2$ | 24.5 | 21.0 | 90 |
| $Sm_{11}Fe_{75.2}N_{12}Ag_{1.8}$ | 24.5 | 20.5 | 85 |
| $Sm_{11}Fe_{75.8}N_{12}Al_{1.2}$ | 24 | 19.5 | 85 |
| $Sm_{11}Fe_{75}N_{12}Cu_{1.0}Al_{1.0}$ | 24 | 20.0 | 83 |
| $Sm_{11}Fe_{74.8}N_{12}Cu_{1.0}Ga_{1.2}$ | 24.8 | 21.5 | 88 |
| $Sm_{11}Fe_{76}N_{12}Zn_{1.0}$ | 21 | 16.0 | 80 |
| $Sm_{11}Fe_{76}N_{12}Sn_{1.0}$ | 20.5 | 16.0 | 78 |
| $Sm_{11}Fe_{76}N_{12}Pb_{1.0}$ | 20.5 | 15.0 | 78 |
| $Sm_{11}Fe_{75.5}N_{12}In_{1.5}$ | 20.7 | 16.0 | 80 |

It is clearly noted from Table 3 that the permanent magnet materials of this invention retained excellent magnetic properties even after the heating test.

The method of production depicted in FIG. 1 is advantageous in that the speed of accumulation of the product is high, the increase of surface area is easy to obtain, the pulverization of the product into minute particles is realized because the melting point of the matrix alloy is lowered by the addition such as of Cu, and the permanent magnet of uniform high-density texture is obtained.

Figure 12:
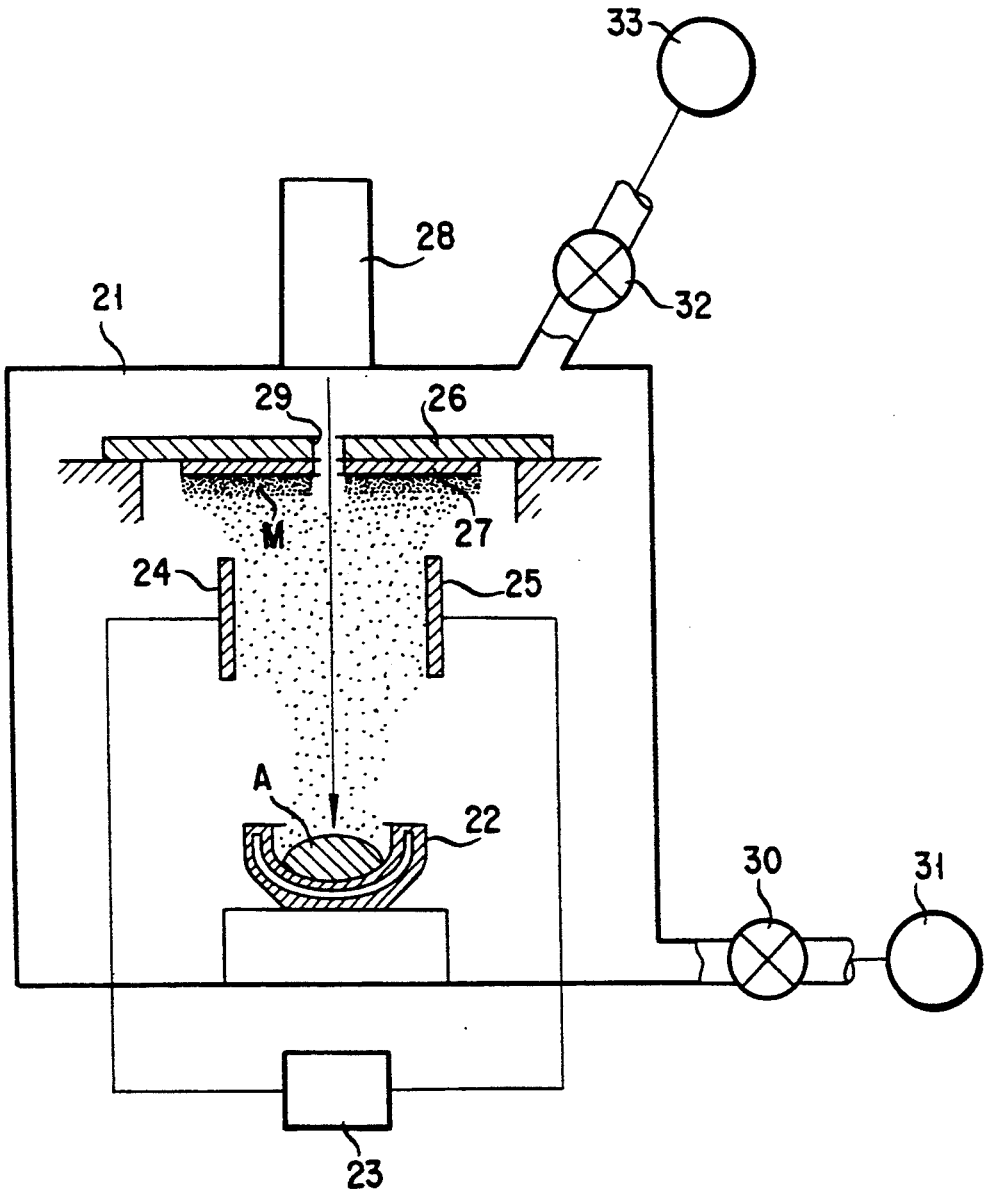
FIG. 12 is a schematic diagram illustrating a second example of the apparatus for the production of a permanent magnet material according to the present invention.

FIG. 12 illustrates another apparatus to be used for the production of a permanent magnet conforming to this invention.

In this apparatus, a water-cooled crucible 22 is disposed in a chamber 21 and a pair of discharge electrodes 24 and 25 connected to a power source 23 are disposed as opposed to each other above the crucible 22. A heating plate 26 is set in place above the two discharge electrodes 24 and 25. A substrate 27 formed of quartz glass or strontium titanate, for example, is attached to the lower surface of the heating plate 26. A laser oscillator 28 is installed in the ceiling part of the chamber 21 and adapted so that a pulse laser emanating from this oscillator 28 advances through a perforation 29 formed in the heating plate 26 and the substrate 27 and impinges on the water-cooled crucible 22. The chamber 21 is connected via first and second valves 30 and 32 respectively to a vacuum pump 31 and a processing gas supply source 33.

For the production of a permanent magnet, the following procedure may be adopted.

(1) A matrix alloy A is placed in the water-cooled crucible 22 and the substrate 27 is heated to a temperature in the range of from 400° to 800°.

(2) With the second valve 32 kept closed and the first valve 30 opened, the vacuum pump 31 is set into operation to decrease the inner pressure of the chamber 21 to a level of about $5\times10^{-5}$ Torr.

(3) With the first valve 30 kept closed and the second valve 32 opened, the processing gas supply source 33 is set into operation to supply the processing gas such as $N_2$ into the chamber 21. The amount of supply of the processing gas is regulated so that the inner pressure of the chamber 21 reaches a level in the range of from about 10 to about 70 cmHg.

(4) A voltage of 2 kV is applied between the two discharge electrodes 24 and 25 to induce generation of plasma. The matrix alloy A is vaporized by projecting the pulse laser from the laser oscillator 28 onto the matrix alloy A.

The resultant vapor of the matrix alloy reacts with the plasma of the processing gas and the product of this reaction is deposited on the substrate 27, to give rise to a permanent magnet M.

The method of production depicted in FIG. 12 is advantageous in respect that the vapor of the matrix alloy is easily combined with N because the treatment proceeds under the reactive plasma, the defilement of the product with the dirt from the atmosphere occurs only sparingly, and the adjustment of the composition of the final product and that of the matrix alloy due to the addition such as of Cu is easy to effect (since the matrix alloy is fused with the pulse laser, local processing is easy to accomplish).

What is claimed is:

1. A permanent magnet material consisting of 6 to 30 atomic % of samarium, 60 to 91 atomic % of a transition element (except for Cu and Ag), 3 to 15 atomic % of nitrogen, and up to 4.5 atomic % of at least one additive element selected from the group consisting of Cu, Ag, Al, Ga, Zn, Sn, In, Bi, and Pb as an inhibitor of thermal decomposition of nitrides.

2. A permanent magnet material according to claim 1, wherein said transition element is Fe.

3. A permanent magnet material according to claim 1, wherein the content of said additive element is in a range which does not result in degradation of the magnetic properties of the magnetic material.

4. A permanent magnet material according to claim 1, wherein said additive element is Cu and/or Al.

5. A permanent magnet material according to claim 1, wherein said additive element is selected from among Ga, Ag, a mixture of Ga and Ag, and a mixture of Ga and Cu and present in an amount of not more than 4 atomic %.

6. A permanent magnet material according to claim 1, wherein said additive element is at least one element selected from among Zn, Sn, and In and present in an amount of not more than 2.5 atomic %.

7. A permanent magnet material according to claim 1, wherein said additive element is Pb and present in an amount of not more than 2 atomic %.

8. A permanent magnet material according to claim 1, wherein said transition element is Co.

9. A permanent magnet material according to claim 1, which has resistance to thermal decomposition of such a degree that a residual ratio of nitrogen in the material after a heating test at 650° C. for five hours is at least 78%.

10. A permanent magnet material according to claim 1, which has been obtained by nitriding constituent elements in a vapor phase state.

11. A permanent magnet material consisting of 6 to 30 atomic % of a rare earth element, 60 to 91 atomic % of a transition element (except for Cu and Ag) 3 to 15 atomic % of nitrogen, and up to 4.5 atomic % of at least one additive element selected from the group consisting of Cu, Ag, Al, Ga, Zn, Sn, In, Bi, and Pb as an inhibitor of thermal decomposition Of nitrides which has been obtained by nitriding constituent elements in a vapor phase state.

12. A permanent magnet material according to claim 11, which has been obtained by vaporizing a material comprising a rare earth element, a transition element and at least one element selected from the group consisting of Cu, Ag, Al, Ga, Zn, Sn, In, Bi, and Pb under reduced pressure, nitriding the material in the state a vapor phase state in an atmosphere containing a nitrogen-containing gas to obtain a nitrided material, and depositing said nitrided material on a substrate heated to a temperature up to about 800° C.

13. A permanent magnet material according to claim 12, wherein said nitrogen-containing gas is selected from the group consisting of nitrogen gas, HCN gas, $NH_3$ gas, and $B_3N_3H_6$ gas.

14. A permanent magnet material according to claim 12, wherein said substrate is heated to a temperature between about 400° C. and about 800° C.

15. A permanent magnet material according to claim 11, which has resistance to thermal decomposition of such a degree that a residual ratio of nitrogen in the material after a heating test at 650° C. for five hours is at least 78%.

16. A permanent magnet material according to claim 11, wherein said rare earth element is Sm.

17. A permanent magnet material according to claim 11, wherein said transition element is Fe.

18. A permanent magnet material according to claim 11, wherein said transition element is Co.

19. A permanent magnet material according to claim 11, wherein said additive element is Cu and/or Al.

20. A permanent magnet material according to claim 11, wherein said additive element is selected from among Ga, Ag, a mixture of Ga and Ag, and a mixture of Ga and Cu and present in an amount of not more than 4 atomic %.

21. A permanent magnet material according to claim 11, wherein said additive element is at least one element selected from among Zn, Sn, and In and present in an amount of not more than 2.5 atomic %.

22. A permanent magnet material according to claim 17, wherein said additive element is Pb and present in an amount of not more than 2 atomic %.

* * * * *